US006913024B2

(12) United States Patent
Anzivino

(10) Patent No.: US 6,913,024 B2
(45) Date of Patent: Jul. 5, 2005

(54) WIG CAP HAVING SYSTEM OF ALTERATION DARTS

(75) Inventor: Robert A. Anzivino, Edison, NJ (US)

(73) Assignee: Love Wigs, Inc., Kenilworth, NJ (US)

( * ) Notice: Subject to any disclaimer, the term of this patent is extended or adjusted under 35 U.S.C. 154(b) by 357 days.

(21) Appl. No.: 10/347,008

(22) Filed: Jan. 17, 2003

(65) Prior Publication Data

US 2004/0139978 A1 Jul. 22, 2004

(51) Int. Cl.[7] ..... A41G 3/00; A41G 5/00
(52) U.S. Cl. ..... 132/53; 132/54
(58) Field of Search ..... 132/53, 54–56, 132/201; 2/195.2

(56) References Cited

U.S. PATENT DOCUMENTS

| | | | | | |
|---|---|---|---|---|---|
| 2,438,005 | A | | 3/1948 | Goldman | 132/53 |
| 3,654,938 | A | | 4/1972 | Spangler et al. | 132/53 |
| 3,835,867 | A | | 9/1974 | Molinario | 132/53 |
| 3,871,389 | A | | 3/1975 | Bauer | 132/53 |
| 4,576,189 | A | * | 3/1986 | Regina | 132/53 |
| 6,105,584 | A | * | 8/2000 | Williams | 132/53 |
| 6,220,249 | B1 | | 4/2001 | Park | 132/53 |
| 6,257,244 | B1 | | 7/2001 | Williams | 132/54 |
| 2001/0013351 | A1 | | 8/2001 | Tang | 132/53 |
| 2003/0116170 | A1 | * | 6/2003 | Nicot et al. | 132/53 |

* cited by examiner

*Primary Examiner*—John J. Wilson
*Assistant Examiner*—Robyn Doan
(74) *Attorney, Agent, or Firm*—Drinker Biddle & Reath LLP

(57) ABSTRACT

A wig includes hair strands secured together by a support structure to form a rounded cap. A system of alteration members includes elongated seams secured to the support structure to define an area of the support structure. The areas defined by the alteration members are preselected to facilitate alteration of the rounded cap by removal of portions of the support structure from the defined areas. The system of alteration members includes transverse members having ends located on the opposite sides of the cap and wedge shaped darts arranged in symmetrical pairs on opposite sides of the cap. A portion of the hair strands is provided by sections having lines of stitching in an edge portion and arranged in layered fashion. Elongated connector strips extend across the layered hair sections to form an orthogonal network structure.

15 Claims, 11 Drawing Sheets

WIG CAP HAVING SYSTEM OF ALTERATION DARTS

FIELD OF THE INVENTION

The present invention relates generally to wig caps, and more particularly to a wig cap alteration system facilitating customized fit to suit individual wearers.

BACKGROUND OF THE INVENTION

In known wigs, strands of hair are secured to a support structure, which forms a rounded "cap" for receipt on a wearer's head. To facilitate manufacture, it is known to provide a wig having cap structure that is sized according to a preselected standard, to fit a user having average head dimensions for example.

To provide for use of a standard sized wig by wearers having differing head dimensions, known wigs include adjustment elements in wig cap structure. It is known, for example, to include elastic elements between portions of the cap structure such as the ear and nape portions for example to provide for circumferential expansion of the wig cap from the preselected standard dimensions. It is also known to include adjustment elements that provide for reduction from the preselected standard dimensions. In either case, however, the expansion or reduction in circumference provided by the adjustment elements does not otherwise change the overall shape of the wig cap from that of the preselected standard. The inclusion of circumferential adjustment elements is, therefore, of limited benefit to users having head shape that differs from the preselected standard dimensions.

SUMMARY OF THE INVENTION

According to one aspect of the invention, a wig includes a plurality of hair strands and a support structure for securing the hair strands together. The support structure forms a rounded cap having opposite side portions for receipt by a person's head. The wig further includes a system of alteration members each including a pair of elongated seams secured to the hair strand support structure to define an area of the support structure. The areas defined by the members are preselected to facilitate alteration of the rounded cap by removal of at least a portion of the support structure within the area defined by at least one of the members.

The system of alteration members includes at least one transversely extending member having ends located on the opposite sides of the cap. The system further includes a pair of members located symmetrically on opposite sides of the cap and defining a wedge shaped area having a wide end located adjacent the transversely extending member.

According to another aspect of the invention, the system of alteration members includes alteration darts defining wedge shaped areas having a wide end. The alteration darts are arranged in a plurality of pairs of darts located symmetrically on opposite sides of the rounded cap.

According to a preferred embodiment of the invention, a portion of the hair strands are provided by hair sections arranged in a layered fashion each having lines of stitching securing the hair strands together in an edge portion of the sections. The support structure includes elongated connector strips extending across the layered hair stations and secured to the edge portions of the hair sections to form an orthogonal network structure.

DETAILED DESCRIPTION OF THE PREFERRED EMBODIMENTS

Figure 1:
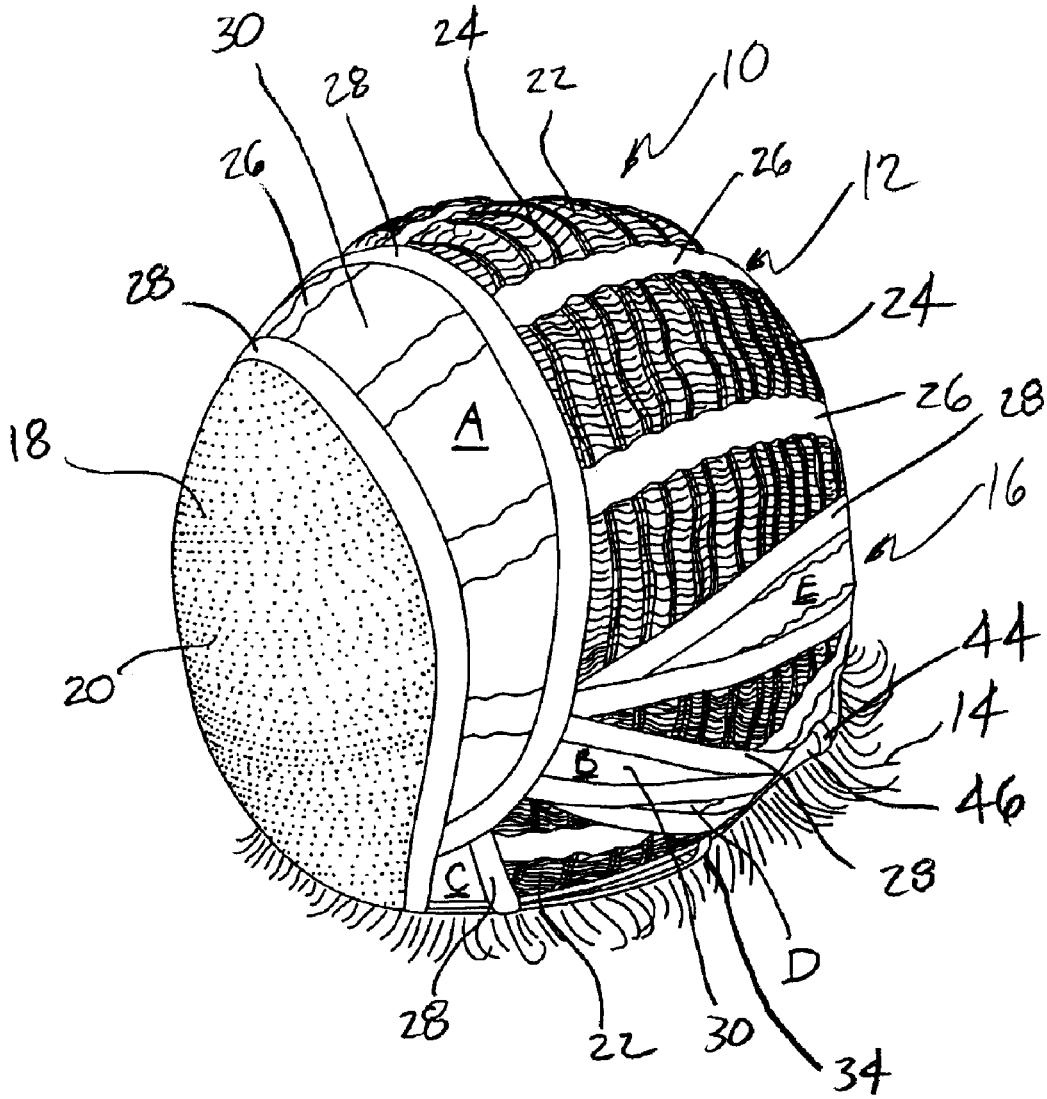
FIG. 1 is a front perspective view of a wig cap according to the present invention.
Figure 2:
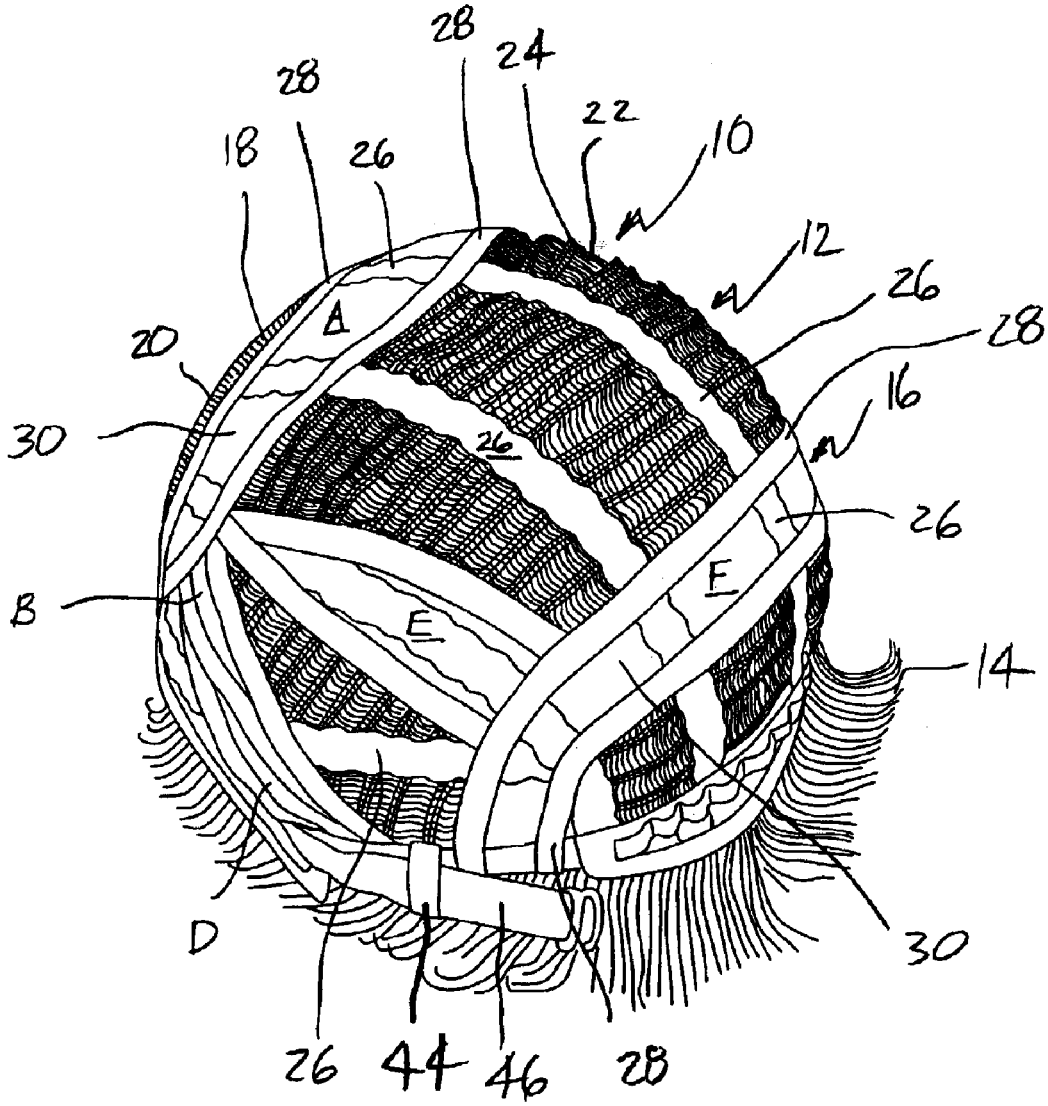
FIG. 2 is a rear perspective view of the wig cap of FIG. 1.

Referring to the drawings, where like numerals identify like elements, there is illustrated in the perspective views of FIGS. 1 and 2 a wig 10 having a cap structure 12 to which the hair strands 14 of the wig are secured. The wig 10 is shown in FIGS. 1 and 2 in an inside-out manner to facilitate illustration of the cap structure 12, which is normally inwardly located with respect to the wig 10. As will be described in greater detail, the wig 10 includes a system 16 of alteration darts secured to the cap structure 12. The system 16 identifies portions of the wig cap structure 12 for removal to effect specific alterations to the size and shape of the wig 10.

Referring to the front perspective view of the wig 10 shown in FIG. 1, the cap structure 12 of wig 10 includes a panel 18 located in a front portion of the wig. In a known manner, hair strands 14 are individually secured to the panel 18 to extend from a surface that is opposite the surface 20. In other portions of the wig 10, the hair is provided by hair sections 22. Each of the hair sections 22, per se known, includes strands of hair secured together by lines of stitching forming a selvage-like edge portion 24 for the section 22. As shown in FIGS. 1 and 2, each of the hair sections 22 is placed atop the preceding section in a layered fashion.

The wig cap structure 12 further includes elongated connector strips 26 extending rearwardly from the front panel 18 across the layered hair sections 22. The connector strips 26 are secured to the hair sections 22, preferably by stitching the connector strips 26 to the edge portions 24. The transverse orientation between the strips 26 and the edge portions 24 of the hair sections 22 to which they are secured creates an orthogonal network structure in the nature of a lattice structure.

Figure 3:
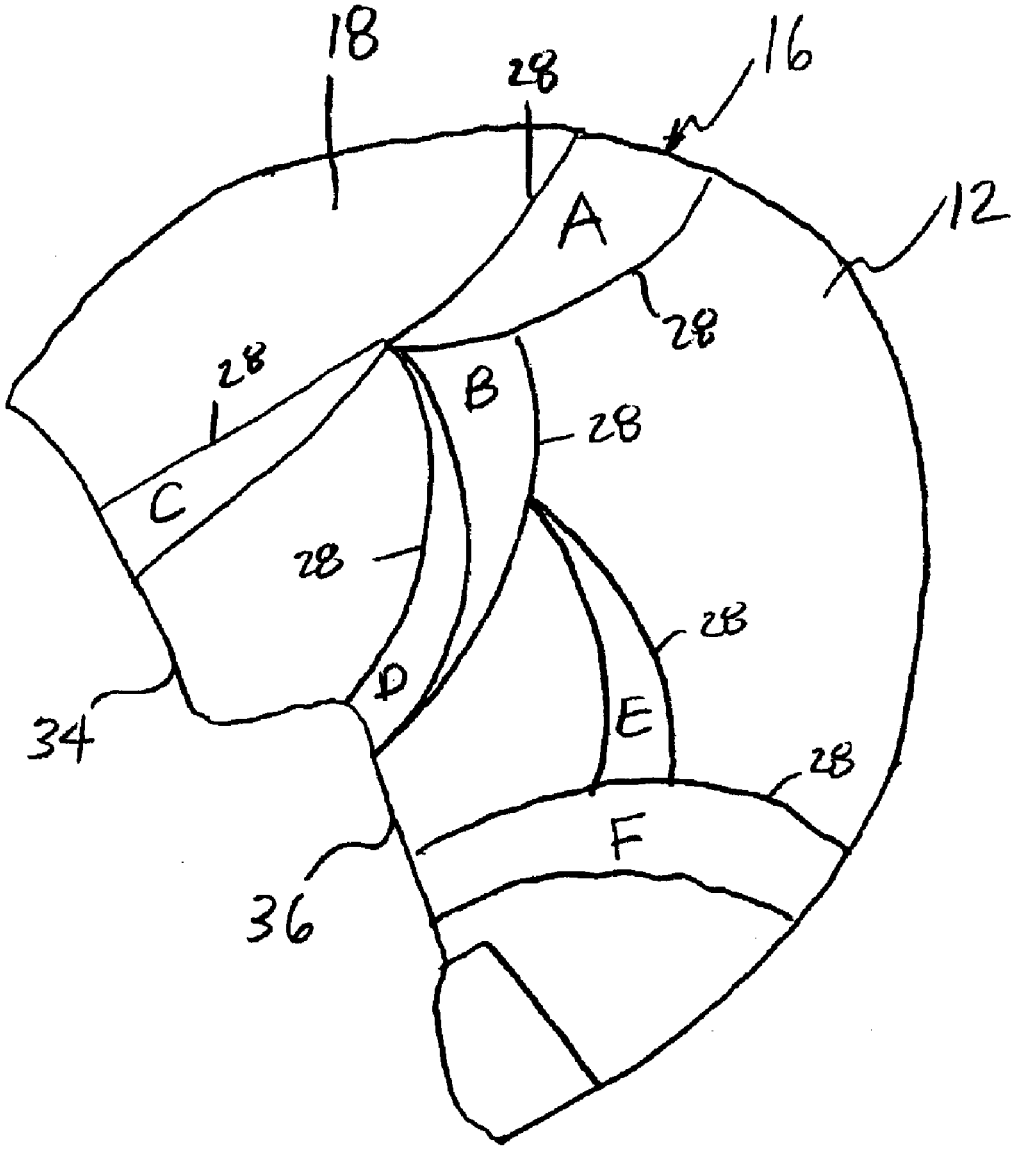
FIG. 3 is a side elevational view of a wig cap schematically illustrating a system of alteration darts according to the present invention.

The alteration darts of system 16 are secured to the network of connector strips 26 and section edge portions 24 to identify specific areas of the network for removal for modifying the size and shape of the wig 10. Referring to FIG. 3, the wig cap structure 12 including the system 16 of alteration darts according to the present invention is shown schematically to illustrate the approximate size, shape and position of the darts of system 16 with respect to the wig cap structure 12 in which it is incorporated. The system 16 of darts is symmetrical with respect to the wig cap structure 12 and includes darts identified as A through F. The system 16 includes one of each of darts A and F extending between opposite sides of wig cap structure 12 and two of each of darts B through E located on the opposite sides.

Referring again to FIGS. 1 and 2, the darts of system 16 are preferably constructed as follows. Each of the darts A through F includes a pair of elongated seams 28 identifying the boundaries of the removal zones. The seams 28 are secured to the underlying network of connector strips 26 and section edge portions 24, preferably by stitching. Each of the darts of system 16 further includes a layer 30 of material extending between the seams 28. The material layer 30 is located between the hair sections 22 and the connector strips 26 and is, therefore, secured within the network when the network is formed by securing the connector strips 26 to the section edge portions 24. The inclusion of the layers 30 serves to visually distinguish the portion of the network associated with the respective dart from other portions of the network thereby limiting the potential for inadvertent removal of other portions of the network.

Removal of portions of the wig cap structure 12 from selected ones of the darts of system 16, as described below, provides for specific alteration of the size and shape of the wig 10. It is important to note that the construction of the darts of system 16 does not require that the entire portion of the wig cap structure 12 associated with a particular dart be removed. In the event that the entire portion of the wig cap structure 12 associated with a dart is removed from the wig 10, the wig cap structure 12 is secured together by connecting the seams 28 of the dart to each other, preferably by stitching. Alternatively, for fitting alterations requiring removal of less than an entire dart, the unremoved portions of the dart are secured together by connecting, preferably by stitching, ends of the connecting strips 26 remaining between the seams 28 of the dart. The capability for removal of sub-portions of the darts of system 16 in this manner provides for finer alterations to be made to the size and shape of the wig 10.

Figure 4:
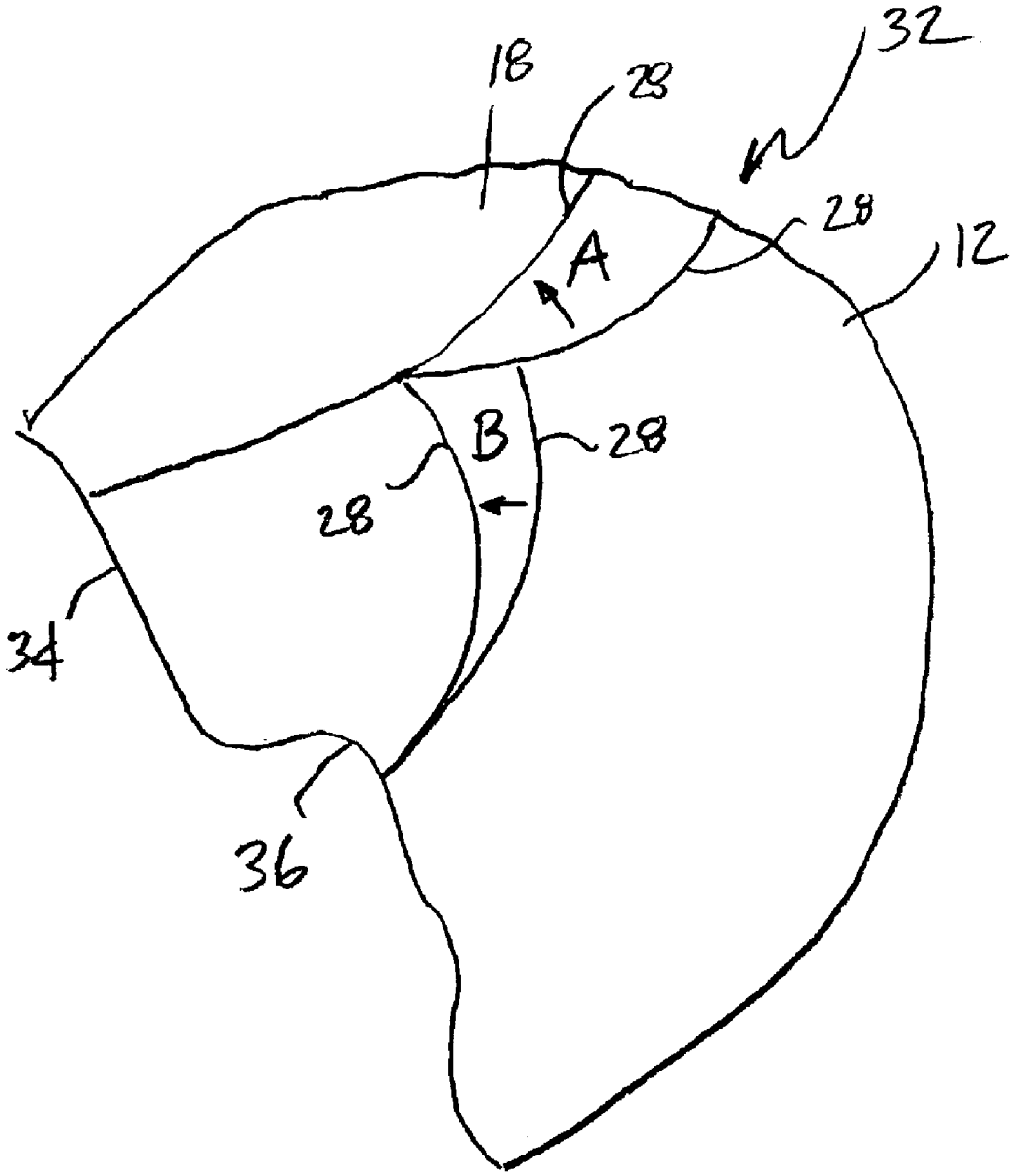
FIGS. 4 and 5 are side elevational views schematically illustrating a first alteration using the system of alteration darts of FIG. 3.
Figure 5:
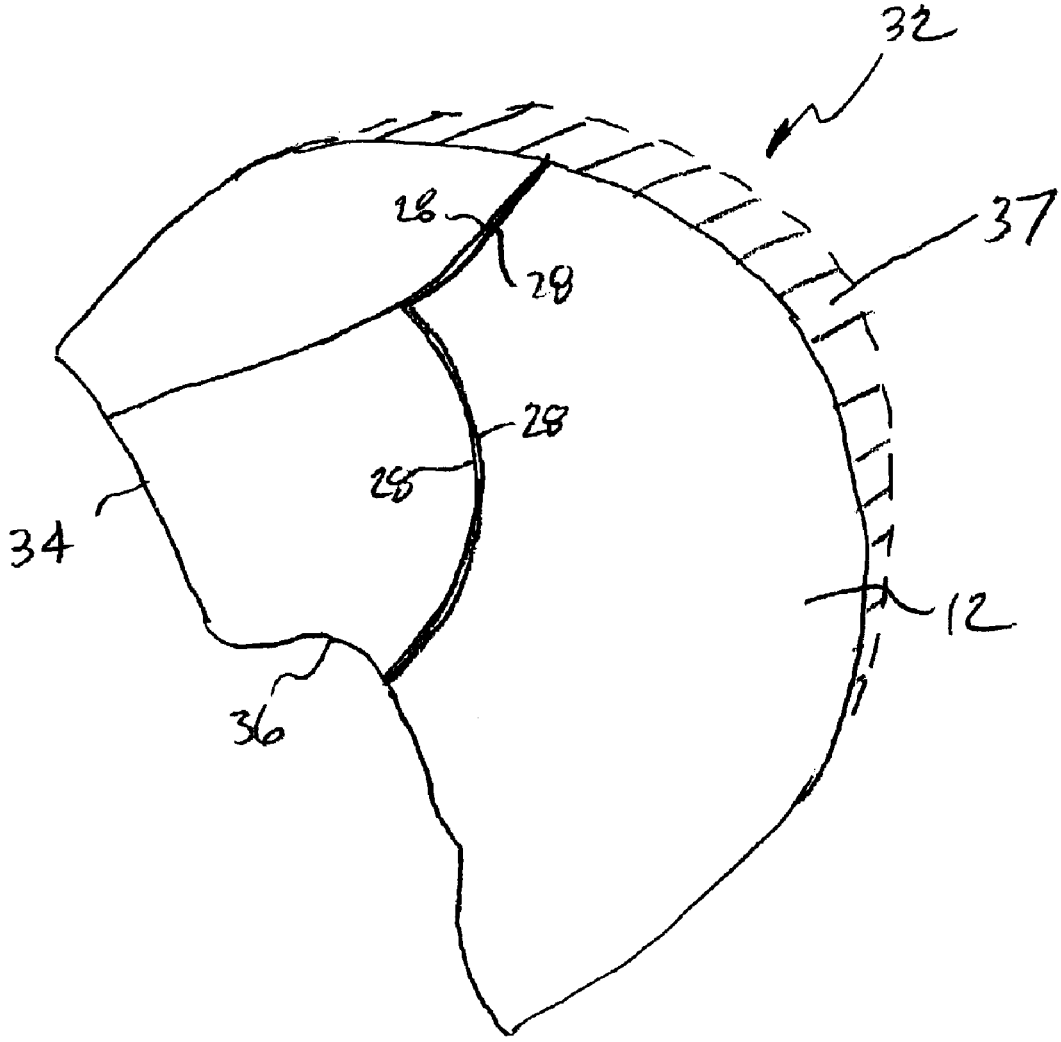

Referring to FIGS. 4 and 5, there is illustrated a first fitting alteration 32 using the darts of system 16 according to the present invention. The first fitting alteration is intended for persons having a head shape that generally matches the unaltered standard-sized wig 10 normal with the exception that the crown of the head is shallower than the standard on which the unaltered wig is based. An unaltered standard wig worn by such a person will tend to be bulky in the crown area of the wig. Darts A and B of system 16 provide for alteration of the standard wig for a person having a shallow crown area. As shown, the single dart A of system 16 extends is located adjacent the front panel 18 and extends along an intermediate portion of the wig cap structure 12 between the opposite sides of the between the opposite sides of the cap structure 12. Each of the B darts is located on one side of the wig cap structure 12 adjacent an end of the A dart. Each of the B darts extends from the end of the A dart to the edge 34 of the wig cap structure 12 adjacent an upper end of the ear portion 36 of the wig 10. As shown, each of the B darts has a tapering width to form a wedge shape having a wide end located adjacent dart A.

Referring to FIG. 4, the A and B darts of system 16 are shown schematically in unaltered condition on the wig cap structure 12. The arrows in FIG. 4 indicate the relative movement that remaining portions of the wig cap structure 12 will experience following removal of portions of the A and B darts and reattachment of the remaining wig cap structure 12. Referring to FIG. 5, the wig cap structure 12 is illustrated following removal of the A and B darts and reattachment of the remaining wig cap structure 12 by sewing seams 28 to each other. The lined portion shown in FIG. 5 represents the changes in the size and shape of the wig cap structure 12 effected by removal of portions of darts A and B. The B darts of system 16 are designed to remove excess material that would otherwise accumulate in the wig cap structure 12 following removal of wig cap structure 12 from dart A. The removal of material from both the A and B darts, therefore, has the effect of reducing the crown portion of the wig 10 while still maintaining perfect roundness of the remaining wig 10 following the alteration.

FIG. 5 illustrates alteration of the wig cap structure 12 by removing all of the wig cap structure 12 identified by the A and B darts and reconnecting the remaining portions of the wig cap structure 12 by sewing the seams 28 of each of darts A and B to each other. As discussed above, however, the present invention does not require removal of all of the structure 12 associated with the darts and provides for removal of less material followed by attachment of remaining ends of connector strips 26 to reconnect the wig cap structure 12. The lined area 37 of FIG. 5 illustrates the reduction in crown size from the unaltered standard wig that is effected by alteration of darts A and B of system 16 according to the first fitting alteration 32.

Figure 6:
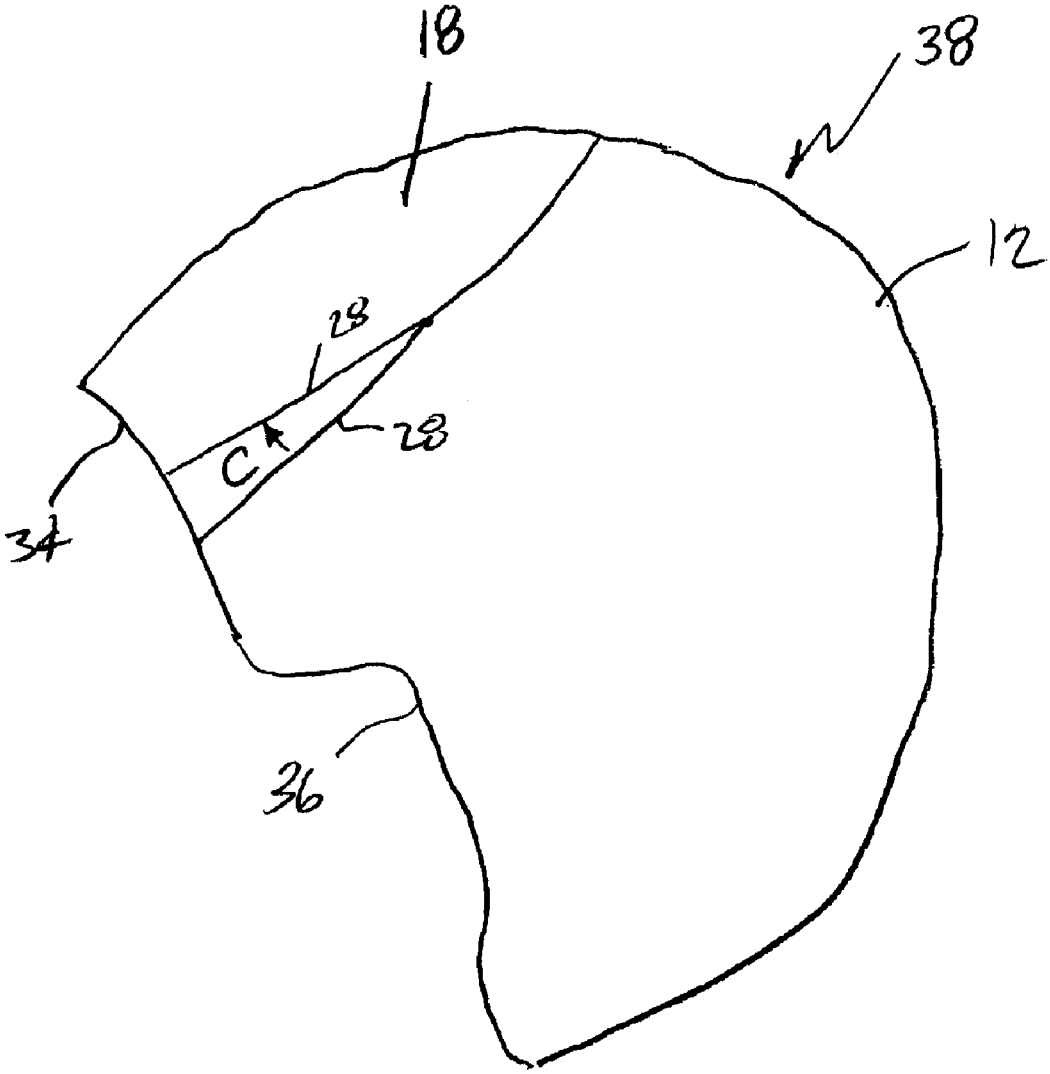
FIGS. 6 and 7 are side elevational views schematically illustrating a second alteration using the system of alteration darts of FIG. 3.
Figure 7:
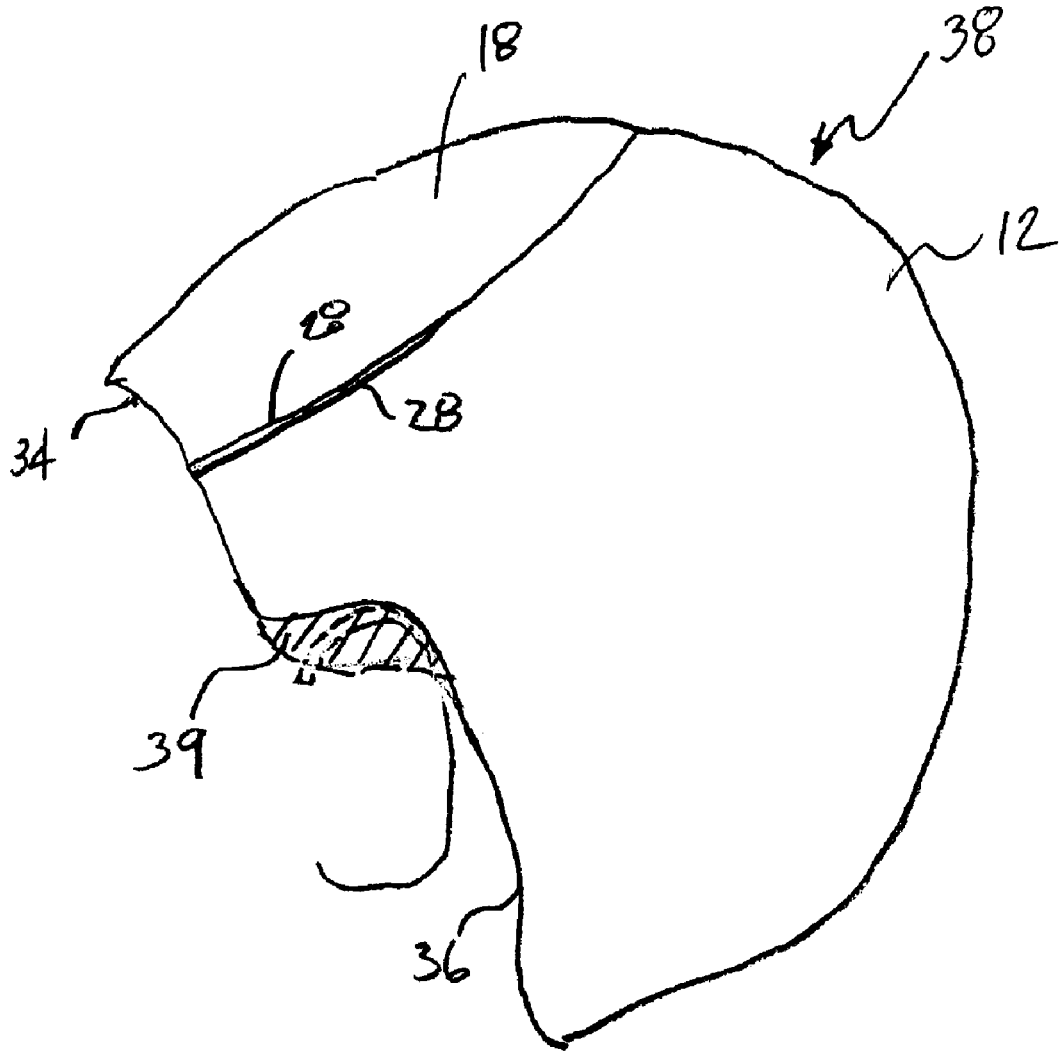

Referring to FIGS. 6 and 7, a second fitting alteration 38 using the system 16 of the present invention is shown. The second fitting alteration 38 is intended for persons whose ears are positioned too highly with respect to the ear portion 36 of the wig 10 as illustrated in FIG. 6. As shown in FIG. 3, each of the C darts of system 16 is located on one side of the wig cap structure 12 and includes a first end adjacent the end of the A dart. Each of the C darts extends adjacent the front panel 18 to the edge of the wig cap structure 12. Each of the C darts has a tapering width to form a wedge shape having a wide end adjacent the edge 34 of the wig cap structure 12 located forwardly of the ear portion 36. The arrow in FIG. 6 indicates the relative movement that remaining portions of the wig cap structure 12 will experience following removal of some or all of the C darts and reattachment of the remaining wig cap structure 12.

Referring to FIG. 7, the wig cap structure 12 is illustrated following removal of the C darts and reattachment of the remaining wig cap structure 12 by sewing seams 28 to each other. The lined portion 39 represents the changes in the size and shape of the wig cap structure 12 effected by removal of cap material from the C darts. As shown, alteration using the C darts of system 16 has the effect of raising the edge of the ear portion 36 of wig cap structure 12, thereby accommodating the higher ears of the individual wearer. The removal of material from the C darts will also have the effect of reducing the circumference of the wig 10 along the edge 34, thereby having the further effect of reducing the outer roundness of the wig 10.

It should be noted that the second fitting alteration 38 according to the present invention does not require a symmetrical removal of material using both of the C darts. Accordingly, the wig cap structure 12 could be unsymmetrically altered using only one of the C darts to remove wig cap material depending on the needs of the individual wearer.

Figure 8:
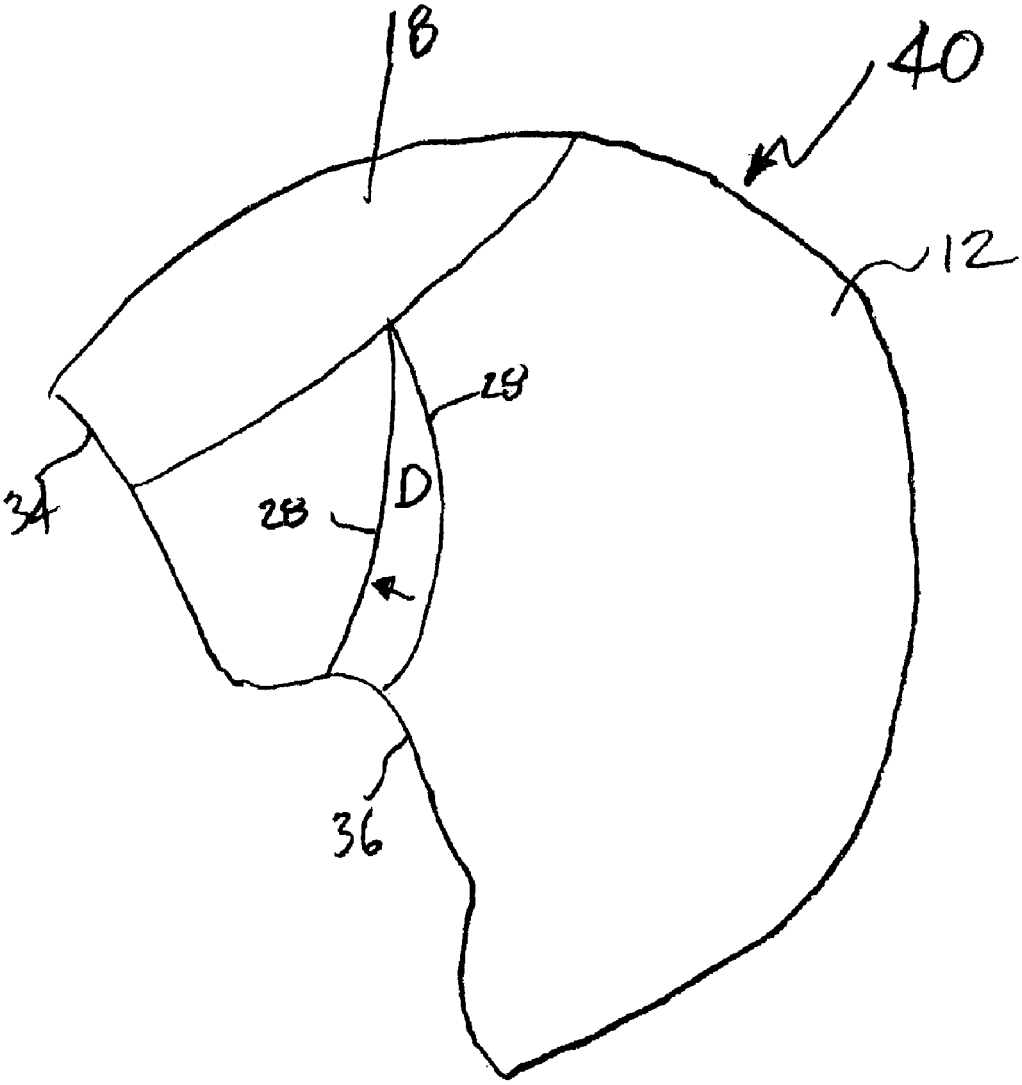
FIGS. 8 and 9 are side elevational views schematically illustrating a third alteration using the system of alteration darts of FIG. 3.
Figure 9:
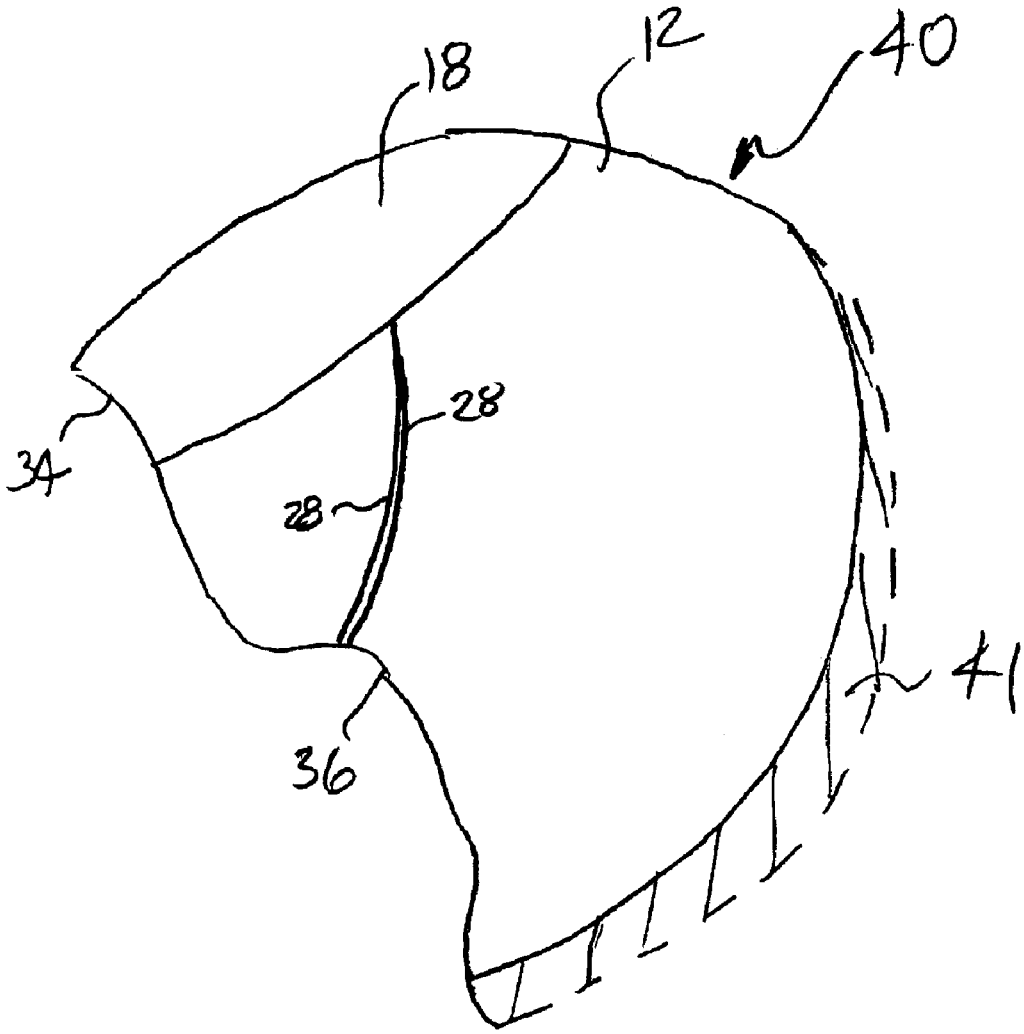

Referring to FIGS. 8 and 9, a third fitting alteration 40 using the system 16 of the present invention is shown. The third fitting alteration 40 is intended for an individual requiring a wig generally smaller in circumference (i.e., the outer roundness size of the wig) than the unaltered standard wig 10. As shown in FIG. 3, each of the D darts of system 16 is located on one side of the wig cap structure 12 and includes a first end adjacent the end of the A dart. Each of the D darts extends adjacent a B dart to the edge 34 of the wig cap structure 12. Each of the D darts has a tapering width to form a wedge shape having a wide end adjacent an upper end of the ear portion 36 of edge 34. The arrow in FIG. 8 indicates the relative movement that remaining portions of the wig cap structure 12 will experience following removal of some or all of the D darts and reattachment of the remaining wig cap structure 12.

Referring to FIG. 9, the wig cap structure 12 is illustrated following removal of the D darts and reattachment of the remaining wig cap structure 12 by sewing seams 28 to each other. The lined portion 41 represents the changes in the size and shape of the wig cap structure 12 effected by removal of cap material from the D darts. As shown, alteration using the D darts of system 16 has the effect of drawing the back portion of the wig 10 toward the front, thereby reducing the outer roundness of the wig cap structure 12.

Figure 10:
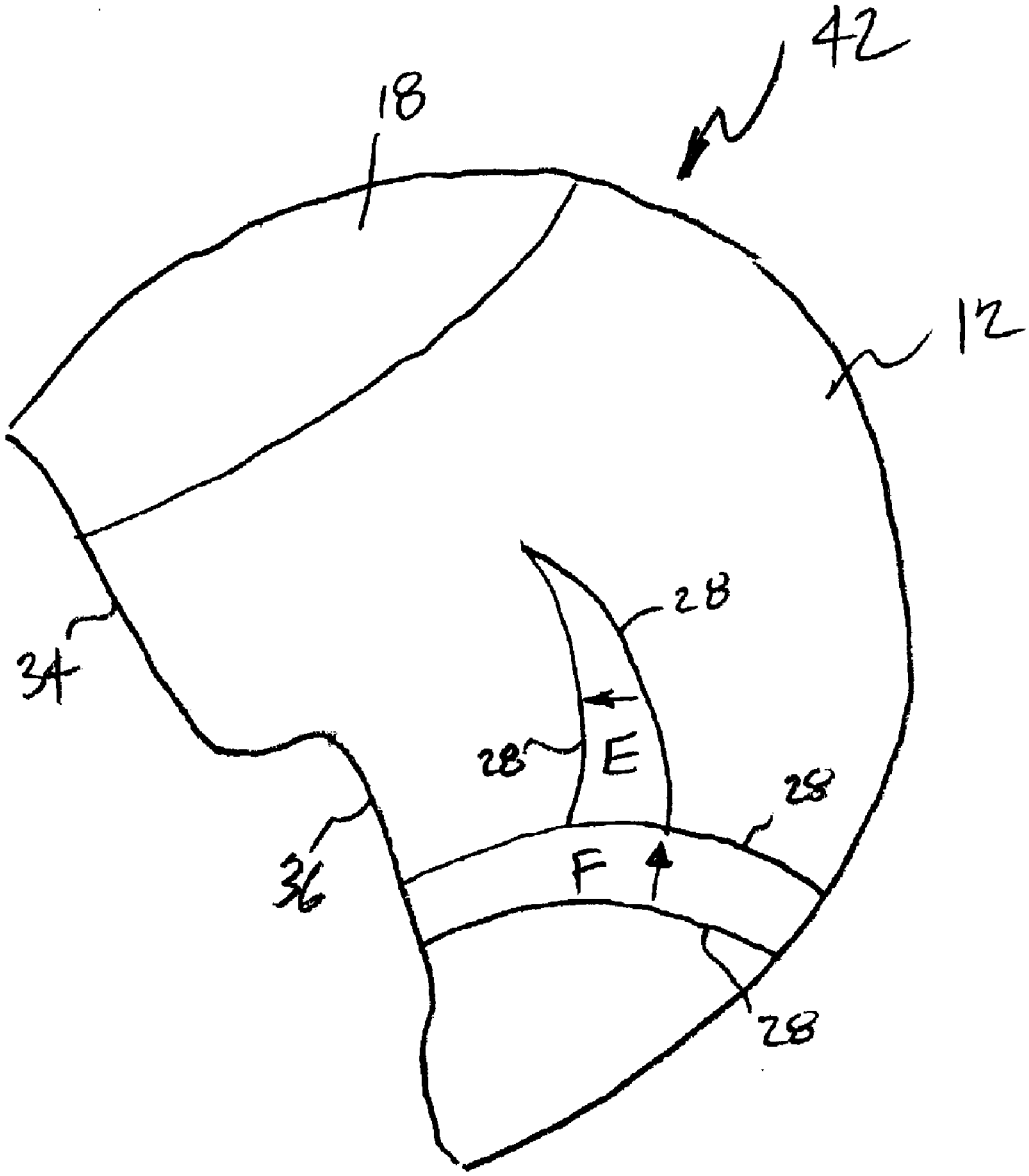
FIGS. 10 and 11 are side elevational views schematically illustrating a fourth alteration using the system of alteration darts of FIG. 3.
Figure 11:
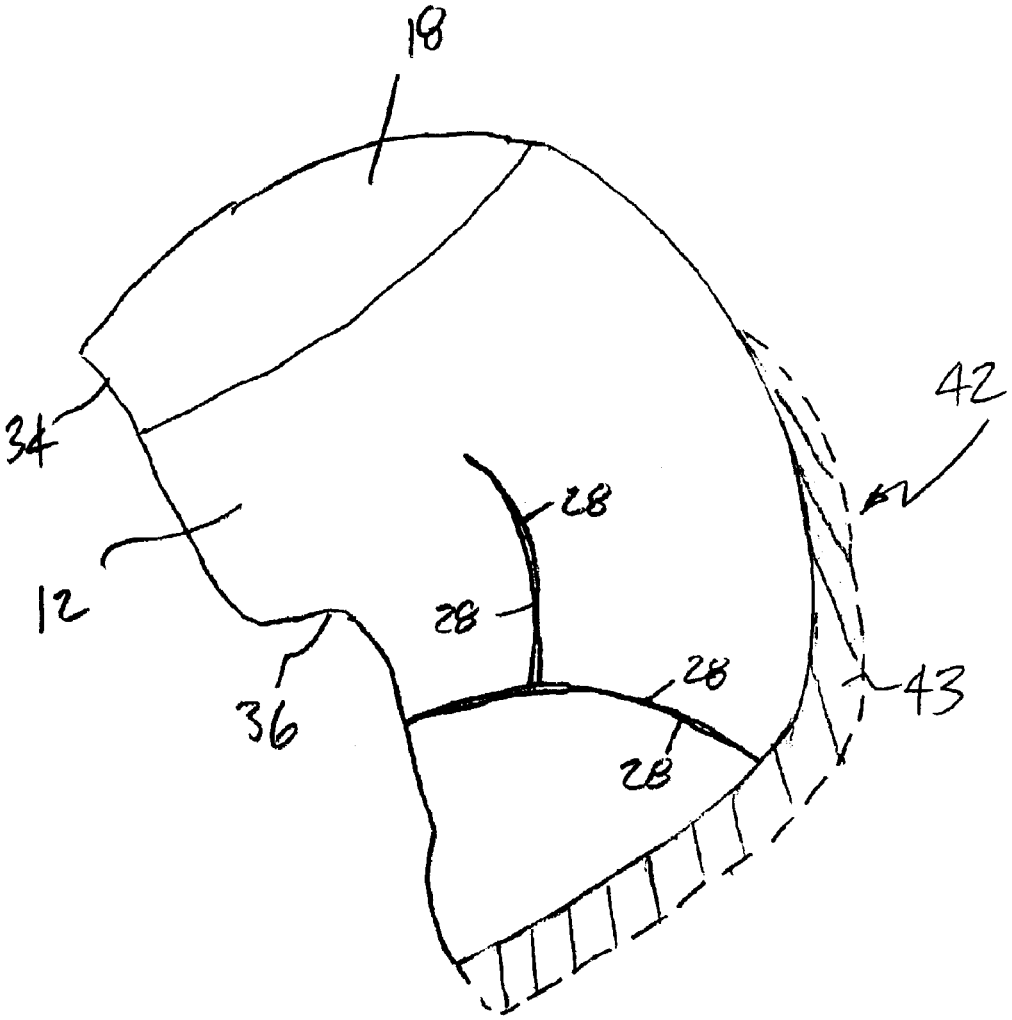

Referring to FIGS. 10 and 11, a fourth fitting alteration 42 using the system 16 of the present invention is shown. The fourth fitting alteration 42 is intended for an individual having a smaller sized head on which the unaltered standard wig 10, if properly placed at the front hairline would extend too far in the back with respect to the back nape area of the individual. As shown in FIGS. 2 and 3, the single dart F extends to the edge 34 of the wig cap structure 12 on each of the opposite sides of the wig 10 in a rearward portion of the wig cap structure 12. Each of the E darts has a first end adjacent an intermediate portion of one of the B darts and extends rearwardly to the F dart. Each of the E darts has a tapering width to form a wedge shape having a wide end adjacent the F dart. The arrows in FIG. 10 indicate the relative movement that remaining portions of the wig cap structure 12 will experience following removal of some or all of the E and F darts and reattachment of the remaining wig cap structure 12.

Referring to FIG. 11 the wig cap structure 12 is illustrated following removal of the E and F darts and reattachment of the remaining wig cap structure 12 by sewing seams 28 to each other. The lined portion 43 represents the changes in the size and shape of the wig cap structure 12 effected by the fourth fitting alteration 42. Alteration using the E and F darts of system 16 has the effect of shortening the distance between the front and back of the wig 10, thereby properly positioning the back nape area of the wig 10 for the individual wearing.

It should be noted that certain of the darts of system 16 could conceivably be used to add material where desired. For example, the single dart F could be removed and replaced by a portion of wig cap material having a greater width than the portion of the wig cap structure 12 removed with dart F. Attachment of the wider portion of wig cap material to the seams 28 of dart F would have the effect of elongated the rearward portion of the wig 10.

Referring again to FIGS. 1 and 2, the wig 10 includes adjustment mechanisms 44 located on each side of the wig cap structure 12 adjacent the edge 34. Each adjustment mechanism 44 includes a strap 46 engaging spaced portions of the cap structure 12 in the known manner to provide for adjustable modification of the circumference of the cap structure 12 adjacent edge 34.

As described above, the cap structure 12 includes hair sections 22 that are layered and then connected together by connector strips 26 secured to edge portions 24 of the hair sections 22 forming a network structure. The present invention, however, is not limited to this construction. For example, a system of alteration darts according to the present invention could be utilized in a hand made wig having a cap structure formed from a mesh material to which individual strands of hair are secured by crocheting the strands.

In the embodiment shown in the figures and described above, the preferred method of attaching the seams 28 of the alteration darts to each other following alteration of the wig 10 is by stitching. It should be noted, however, that the invention is not limited to attachment by stitching. It is conceivable that the seams of the alteration darts could incorporate other means of attachment, such as hook and loop materials for example.

The foregoing describes the invention in terms of embodiments foreseen by the inventor for which an enabling description was available, notwithstanding that insubstantial modifications of the invention, not presently foreseen, may nonetheless represent equivalents thereto.

What is claimed is:

1. A wig comprising:

a plurality of hair strands;

a support structure secured to the hair strands, the support structure defining a rounded cap for receipt by a person's head, the rounded cap having opposite side portions; and a system of alteration members each including a pair of elongated seams secured to the hair strand support structure to define an area of the support structure, the areas defined by the members being preselected to facilitate alteration of the rounded cap by removal of at least a portion of the support structure within the area defined by at least one of the members, the system including at least one transversely extending alteration member having ends located on the opposite sides of the cap, the system further including a pair of members located symmetrically on opposite sides of the cap and defining a wedge shaped area having a wide end located adjacent the transversely extending member.

2. The wig according to claim 1, wherein the support structure includes a panel located in a front portion of the cap formed by the support structure, and wherein the at least one transversely extending alteration member includes a member located adjacent the panel.

3. The wig according to claim 2, wherein the cap includes an edge extending about both sides of the cap and wherein each member of the pair of members includes an end opposite the wide end located adjacent the edge.

4. The wig according to claim 1, wherein the at least one transversely extending alteration member includes a member located in a rearward portion of the rounded cap.

5. The wig according to claim 1, wherein the cap includes an edge extending about both sides of the cap, the edge including an ear portion on each side of the cap adapted to accommodate a person's ear, and wherein the system of alteration members further includes an additional pair of members located symmetrically on opposite sides of the cap, the additional pair defining a wedge shaped area forwardly located from one of the ear portions and having a wide end adjacent the edge.

6. The wig according to claim 1, wherein the cap includes an edge extending about both sides of the cap, the cap having an ear portion located on each of the opposite sides of the cap to accommodate a person's ear, and wherein the system of alteration members further includes an additional pair of members located symmetrically on opposite sides of the cap, each member of the additional pair defining a wedge shaped area having a wide end adjacent one of the opposite ear portions of the edge.

7. The wig according to claim 6, wherein the support structure includes a panel portion located in a front portion of the cap formed by the support structure and wherein each member of the additional pair includes an end opposite the wide end located adjacent the front panel of the support structure.

8. The wig according to claim 1, wherein at least a portion of the strands of hair are provided by hair sections each having lines of stitching securing the hair strands together in an edge portion of the sections, the hair sections being arranged in a layered fashion, and wherein the support structure includes elongated connector strips extending across the layered hair sections, the connector strips being secured to the edge portions of the hair sections to form an orthogonal network structure.

9. The wig according to claim 8, wherein the seams of each of the alteration members is secured to the orthogonal network structure.

10. The wig according to claim 9, wherein each of the alteration members includes a layer of material extending between the associated seams of the alteration member.

11. The wig according to claim 10, wherein the layer of material for each of the alteration members is located between the edge portions of the hair sections and the connector strips.

12. A wig comprising:

a plurality of hair strands;

a hair support structure to which the hair strands are secured, the hair support structure defining a rounded cap for receipt by a person's head, the rounded cap having opposite side portions; and a system of alteration members each including two elongated seams secured to the hair support structure to define an area of the support structure, the areas being preselected to facilitate alteration of the rounded cap by removal of at least a portion of the hair support structure within the area defined by at least one of the alteration members, the system of alteration members including alteration darts each defining a wedged shape area having a wide end, the alteration darts being arranged in a plurality of pairs located symmetrically on opposite sides of the rounded cap.

13. The wig according to claim 12, wherein the hair support structure includes a panel located in a front portion of the rounded cap and wherein the plurality of pairs of alteration darts includes a pair of darts extending adjacent to the front panel.

14. The wig according to claim 12, wherein the rounded cap formed by the hair support structure includes an edge having opposite ear portions adapted to accommodate a person's ears and wherein the plurality of pairs of alteration darts includes a pair of darts each having an end located adjacent one of the opposite ear portions of the cap edge.

15. The wig according to claim 12, wherein the system alteration members further includes at least one transversely extending member having ends located on the opposite sides of the rounded cap and wherein the plurality of pairs of alteration darts includes a pair of darts each having an end located adjacent one of the opposite ends of the transversely extending member.

* * * * *